US010851772B2

(12) United States Patent
Junginger

(10) Patent No.: US 10,851,772 B2
(45) Date of Patent: Dec. 1, 2020

(54) HYDRAULIC DRIVE

(71) Applicant: Voith Patent GmbH, Heidenheim (DE)

(72) Inventor: Magnus Junginger, Königsbronn (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 16/277,432

(22) Filed: Feb. 15, 2019

(65) Prior Publication Data

US 2019/0178242 A1 Jun. 13, 2019

Related U.S. Application Data

(63) Continuation of application No. PCT/EP2017/069008, filed on Jul. 27, 2017.

(30) Foreign Application Priority Data

Aug. 17, 2016 (DE) ..... 10 2016 215 311

(51) Int. Cl.
*F04B 49/00* (2006.01)
*F15B 7/00* (2006.01)
(Continued)

(52) U.S. Cl.
CPC ..... *F04B 49/002* (2013.01); *F01L 1/46* (2013.01); *F04B 1/0421* (2013.01); *F15B 7/006* (2013.01);
(Continued)

(58) Field of Classification Search
CPC .... F15B 2011/0243; F15B 2211/20515; F04B 49/002
(Continued)

(56) References Cited

U.S. PATENT DOCUMENTS 5,996,465 A 12/1999 Morikawa et al.
7,254,945 B1 * 8/2007 Sakai ..... F15B 7/006 60/476
(Continued)

FOREIGN PATENT DOCUMENTS

CN 105041745 A 11/2015
DE 100 26 223 A1 10/2002
(Continued)

OTHER PUBLICATIONS

Notice of Transmission of the International Research Report and the Written Notice Issued the International Searching Authority or Declaration dated Nov. 2, 2017 for International Application No. PCT/EP2017/069008 (14 pages).
(Continued)

*Primary Examiner* — Thomas E Lazo
*Assistant Examiner* — Daniel S Collins
(74) *Attorney, Agent, or Firm* — Taylor IP, P.C.

(57) ABSTRACT

The invention relates to a hydraulic drive having a differential cylinder which has a cylinder piston and a piston rod which is connected to the cylinder piston. The cylinder piston is arranged in a displaceable manner in a cylinder chamber in order to extend and retract piston rod. The cylinder chamber is separated by cylinder piston into a piston side, and a ring side with piston rod, each with a variable volume. The piston side and ring side are separated from one another by the piston and are connected to one another in a fluid conducting manner via a short-circuit line. The short-circuit line includes a switching valve for optionally shutting off short-circuit line in a fluid-tight manner. A switching valve can be switched into its blocking position at least indirectly in dependence on the pressure on piston side of cylinder chamber.

10 Claims, 3 Drawing Sheets

(51) Int. Cl.
*F01L 1/46* (2006.01)
*F04B 1/0421* (2020.01)
*F15B 11/024* (2006.01)

(52) U.S. Cl.
CPC ..... *F15B 2011/0243* (2013.01); *F15B 2211/20515* (2013.01); *F15B 2211/20561* (2013.01); *F15B 2211/27* (2013.01); *F15B 2211/3051* (2013.01); *F15B 2211/7053* (2013.01); *F15B 2211/775* (2013.01)

(58) Field of Classification Search
USPC ..... 60/476
See application file for complete search history.

(56) References Cited

U.S. PATENT DOCUMENTS

| | | | |
|---|---|---|---|
| 2007/0209502 | A1 | 9/2007 | Pasquali |
| 2010/0193714 | A1 | 8/2010 | Hankinson et al. |
| 2010/0212521 | A1 | 8/2010 | Resch et al. |
| 2013/0081382 | A1 | 4/2013 | Nelson et al. |

FOREIGN PATENT DOCUMENTS

| | | | |
|---|---|---|---|
| DE | 101 29 072 | A1 | 12/2002 |
| DE | 10 2004 048 649 | A1 | 4/2006 |
| DE | 10 2014 218 887 | B3 | 1/2016 |
| DE | 10 2014 016 296 | A1 | 5/2016 |
| JP | 2006-256180 | A | 9/2006 |

OTHER PUBLICATIONS

Result of the Determination of the Prior Art dated Jun. 1, 2017 for German Application No. 10 2016 215 857.0 (2 pages).
Alan Hitchcox, "Regenerative Circuits Made Easy", Hydraulics and Pneumatics, Penton Media, BD. 65, Nr. 11, Nov. 1, 2012, pp. 16-17 (2 pages).
Chinese Office Action dated Jul. 2, 2020 for Chinese Application No. 201780050051.7 (8 pages).
English translation of Chinese Office Action dated Jul. 2, 2020 for Chinese Application No. 201780050051.7 (11 pages).

* cited by examiner

HYDRAULIC DRIVE

CROSS REFERENCE TO RELATED APPLICATIONS

This is a continuation of PCT application No. PCT/EP2017/069008, entitled "HYDRAULIC DRIVE", filed Jul. 27, 2017, which is incorporated herein by reference.

BACKGROUND OF THE INVENTION

1. Field of the Invention

The current invention relates to a hydraulic drive, more particularly to a hydraulic drive with a differential cylinder.

2. Description of the Related Art

Hydraulic drives of this type are known for example from DE 10 2014 016 296 A1. The hydraulic drive described therein allows for a rapid and a load stroke mode. In the rapid stroke mode, hydraulic fluid is moved with the piston rod out of one ring side to the piston side of the differential cylinder, in order to more rapidly move the cylinder piston in the cylinder chamber. In the load stroke mode, where a greater force of the piston rod is necessary, for example to power a press plunger, the hydraulic fluid is moved out of the ring side into a hydraulic fluid reservoir. The hydraulic fluid is moved exclusively by pumping out of the fluid reservoir into the piston side.

Even though with the cited hydraulic drive, a changeover between rapid stroke mode and load stroke mode can occur automatically, the design is complicated due to multiple connections of various switching valves through which the hydraulic fluid flows out of the ring side or more specifically into the piston side of the cylinder and the flow losses are comparatively great due to the long flow paths of the hydraulic fluid.

DE 10 2014 218 887 B3 discloses a hydraulic drive having two synchronized cylinders whose piston rods are mechanically coupled with one another on one side of the cylinders, so that in a rapid stroke mode only the first synchronized cylinder is driven by the hydraulic pump and the second synchronized cylinder is moved along mechanically. In a load stroke mode, both synchronized cylinders are driven hydraulically by fluid from the hydraulic pump. To allow the second synchronized cylinder to be moved along, a short-circuit with a check valve between its two ring sides is provided.

What is needed in the art is a simple design that provides reliable shifting between the load stroke and rapid stroke.

Also needed in the art is a simple design that reduces flow loss and is cost effective.

SUMMARY OF THE INVENTION

The present invention provides a hydraulic drive having a differential cylinder. The differential cylinder includes a cylinder piston and a piston rod attached on the cylinder piston. Based on the design of the cylinder as a differential cylinder, a piston rod is provided only on one side of the cylinder piston, so that the cylinder chamber, in which the cylinder piston is arranged in a displaceable manner in order to extend and retract the piston rod, is separated by the cylinder piston into a ringside with the piston rod and into a piston side that is free of a piston rod, wherein because of the movability of the cylinder piston both sides of the cylinder chamber have a variable volume.

The piston side and the ring side of the cylinder chamber are connected with one another in a fluid conducting manner via a short-circuit line, so that it is possible to let hydraulic fluid flow in a rapid stroke mode at least out of the ring side into the piston side, and in fact over the shortest path without involving use of a pump.

A switching valve is provided in the short-circuit line for optionally shutting off the short-circuit line in a fluid-tight manner, to thereby switch the hydraulic drive into a load stroke mode.

Furthermore, a hydraulic pump is provided which is connected to the differential cylinder via hydraulic lines in order to deliver a hydraulic fluid optionally to the piston side or the ring side, thereby displacing the piston in an alternating fashion in the cylinder chamber.

Depending at least indirectly upon the pressure on the piston side of the cylinder chamber, the switching valve can be switched mechanically, hydraulically and/or electrically, in particular automatically into its blocking position.

In an exemplary embodiment, a single switching valve is provided in the short circuit line, to block the short circuit line.

It is conceivable to reduce the flow losses to a minimum, in particular in the rapid stroke mode, due to the fact that the short-circuit line can be configured to be comparatively short and hydraulic fluid flowing from the ring side to the piston side needs to flow only through the single switching valve. Thus, especially high speeds, in particular when extending the piston can be reached.

Moreover, heat influx into the hydraulic fluid or more specifically into the hydraulic drive are minimized due to the extremely low flow losses.

The switching valve may be designed as a multi-way valve, especially a 3/2 way valve.

It may be advantageous if the multi-way valve is spring pre-loaded in order to be moved when triggered, subject to the pressure on the piston side, against a spring force into the blocked position and through spring force in a non-controlled condition into the open position.

The hydraulic pump has for example, two sides connected to the cylinder chamber, each respectively via a hydraulic line, and in each of the two hydraulic lines a check valve is provided which opens in the direction of the cylinder chamber.

In addition to an inlet and an outlet, the two check valves each may include a control connection to their forced opening. Via this forced opening, each of the check valves can be opened against its differential force that acts through the inlet and outlet. The differential force results from the fluid pressure prevailing at a given time in the outlet and the fluid pressure prevailing at a given time in the inlet, and as a rule, from a spring force of the check valve acting in direction of closure.

The control connections to the forced opening of the check valves can be interconnected crosswise with the inlets hydraulically or otherwise pressure-dependent in such a manner that a pressure above a predetermined pressure threshold in a respective inlet of a check valve forcibly opens the other check valve via the control connection.

A hydraulic fluid reservoir may be provided which is connected via a fluid volume equalizer check valve on both sides of the pump. In one embodiment, the term "fluid volume equalizer check valve" is selected to distinguish these fluid volume equalizer check valves from check valves which are equipped with forced opening.

According to one embodiment of the invention, each of the hydraulic lines is connected on both sides of the pump respectively via a pressure relief valve on the hydraulic fluid reservoir.

Depending upon the pressure of the hydraulic line that is attached on the ring side of the cylinder chamber, the switching valve may be switchable into its blocking position. The pressure between the pump and the check valve can be used for this purpose.

The pump may be reversible in its delivery direction and in particular in its direction of rotation, for example two two-quadrant pumps or one four-quadrant pump.

The surface ratio of the effective piston surface on the piston side relative to the effective surface on the ring side is preferably between 2.0 and 3.0, in particular between 2.3 and 2.8, for example 2.5. The smaller the surface ratio, the greater the speed increase during switching from the load stroke mode into the rapid stroke mode. For example, a piston speed of 200 mm/s or more, in particular 250 or 270 mm/s can be achieved in the rapid stroke mode.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrates embodiments of the invention and such exemplifications are not to be construed as limiting the scope of the invention in any manner.

DETAILED DESCRIPTION OF THE INVENTION

Figure 1:
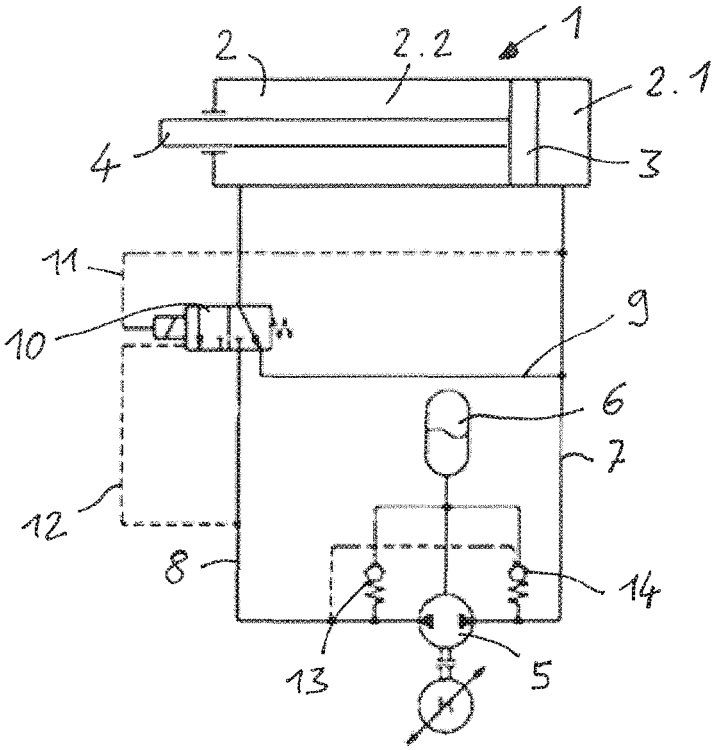
FIG. 1 shows one possible embodiment according to the invention.

Referring now to the drawings, and more particularly to FIG. 1, there is shown an illustration of an exemplary arrangement of an inventive hydraulic drive with a differential cylinder 1, having cylinder piston 3, mounted in a displaceable manner in a cylinder chamber 2. Cylinder piston 3 separates cylinder chamber 2 into a piston side 2.1 and a ring side 2.2. On piston side 2.1, a fully circular pressure surface acts upon cylinder piston 3. On ring side 2.2, an annular pressure surface acts upon cylinder piston 3, due to piston rod 4 which is connected on cylinder piston 3.

A hydraulic pump 5 is provided which, in the present embodiment can be operated in two opposing rotational directions, so that hydraulic pump 5 can electively pump hydraulic fluid from hydraulic fluid reservoir 6 into each of the two hydraulic lines 7 and 8, via which hydraulic pump 5 is connected to differential cylinder 1 or more specifically to cylinder chamber 2 of same.

Using hydraulic pump 5, hydraulic fluid can be pumped through first hydraulic line 7 to piston side 2.1, in order to extend the cylinder piston from the housing of differential cylinder 1. Hydraulic fluid can be pumped through second hydraulic line 8, hydraulic fluid can be pumped by the hydraulic pump 5 to ring side 2.2 of cylinder chamber 2, in order to retract cylinder piston 4.

Cylinder piston 3 separates piston side 2.1 in a fluid-tight manner from ring side 2.2. However, a short-circuit line 9 is provided, through which piston side 2.1 is connected with ring side 2.2 in a fluid-conducting manner in order to move cylinder piston 3 quickly in a rapid stroke mode. For elective opening and blocking of short-circuit line 9, a switching valve 10 is provided in short-circuit line 9. In one embodiment, switching valve 10 is positioned in a branch off of short-circuit line 9 from hydraulic line 8.

Switching valve 10 is the only valve in short-circuit line 9, so that the flow losses are minimized.

In one embodiment, switching valve 10 is in the embodiment of a 2/3 way valve which is pre-tensioned by a pressure spring in the direction of its open position, and depending on the hydraulic pressure is blocked on piston side 2.1 of cylinder chamber 2, so that hydraulic fluid can no longer flow through shirt-circuit line 9.

In another embodiment, switching valve 10 is for example connected via a pressure conducting connection 11 with first hydraulic line 7 in order to immediately capture the pressure on piston side 2.1. An additional pressure conducting connection 12 of switching valve 10 can possibly be provided with second hydraulic line 8, in order to also consider the pressure in this line as a pre-set condition for switching of switching valve 10. It is moreover possible to provide an electrical actuation of switching valve 10 instead of a hydraulic connection, in particular in order switch said valve into its blocked position.

Moreover, hydraulic fluid reservoir 6 is also connected to its fluid conducting connection with a suction side of hydraulic pump 5 via respective fluid equalizer check valve 13, 14 with respective hydraulic lines 7, 8 to feed additional hydraulic fluid from hydraulic fluid reservoir 6 into one of the two hydraulic lines 7, 8 when required. In addition, at least one of the two fluid equalizer check valves 13, 14 can be equipped with a forced opening connection to the respective other hydraulic line 7, 8, for example to forcibly open fluid equalizer check valve 14 that is connected to first hydraulic line 7 in the event of a pressure increase in second hydraulic line 8 in order to thus direct surplus hydraulic fluid into hydraulic fluid reservoir 6.

Figure 2:
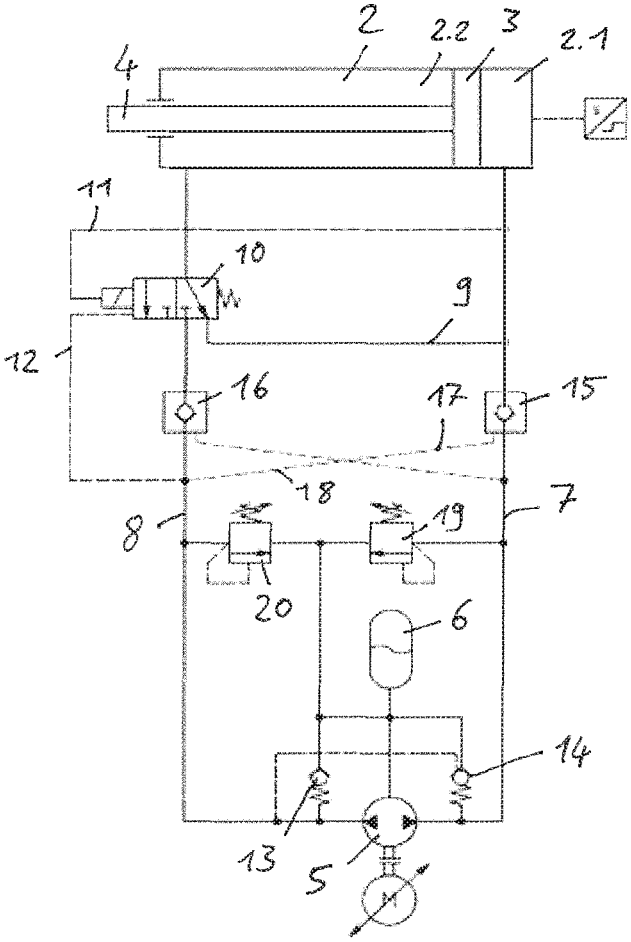
FIG. 2 shows another embodiment of the invention.

The embodiment shown in FIG. 2 differs from that in FIG. 1 in that in each of the two hydraulic lines 7, 8 a check valve 15, 16 is provided which opens in the direction of cylinder chamber 2. The two check valves 15, 16 are equipped with a cross over control connection to the force opening, see control lines 17 and 18. Respective check valve 15, 16 is then forcibly opened via these control lines 17 and 18 when the pressure in the respective other hydraulic line 7, 8 exceeds a pre-set value.

In the embodiment shown in FIG. 2, each of the two hydraulic lines 7, 8 is moreover connected with hydraulic fluid reservoir 6 via a pressure relief valve 19, 20 in order to limit the maximally possible pressure in hydraulic lines 7, 8.

When extending cylinder piston 4 in the rapid stroke mode, hydraulic pump 5 rotates clockwise. Hydraulic fluid, in particular oil flows through check valve 15 into piston side 2.1 of cylinder chamber 2 in differential cylinder 1. Switching valve 10 is in the starting position, as illustrated. As a result, the volume stream of hydraulic fluid which is pushed out of ring side 2.2 flows through short-circuit line 9 into piston side 2.1. The speed of extension of cylinder piston 4 is therefore comparatively high. The side of hydraulic pump 5 on which second hydraulic line 8 is connected can be supplied with hydraulic fluid from upstream hydraulic fluid reservoir 6 via fluid volume equalizer check valve 13.

Extending of cylinder piston 4 in the load stroke mode can occur by driving hydraulic pump 5 in the same direction, for example again in clockwise direction. Hydraulic fluid flows again via first hydraulic line 7 with check valve 15 into ring side 2.1. Above a certain pressure in ring side 2.1 or rather in first hydraulic line 7, switching valve 10 is activated, as a result of which the hydraulic fluid is moved out of ringside 2.2 back to hydraulic pump 5. A differential volume is subsequently fed via fluid volume equalizer valve 13.

During retraction, the hydraulic pump rotates in opposite direction, for example counter clockwise. At the same time, switching valve 10 can be activated electrically, mechanically or hydraulically in order to block short-circuit line 9. Hydraulic fluid flows from hydraulic pump 5 via second hydraulic line 8 with check valve 16 through switching valve 10 in ring side 2.2 of cylinder chamber 2. As a result of the pressure increase on this side of cylinder chamber 2, or more specifically in second hydraulic line 8, fluid volume equalizer valve 14 is opened. The excess hydraulic fluid is thus directly conducted into hydraulic fluid reservoir 6.

Figure 3:
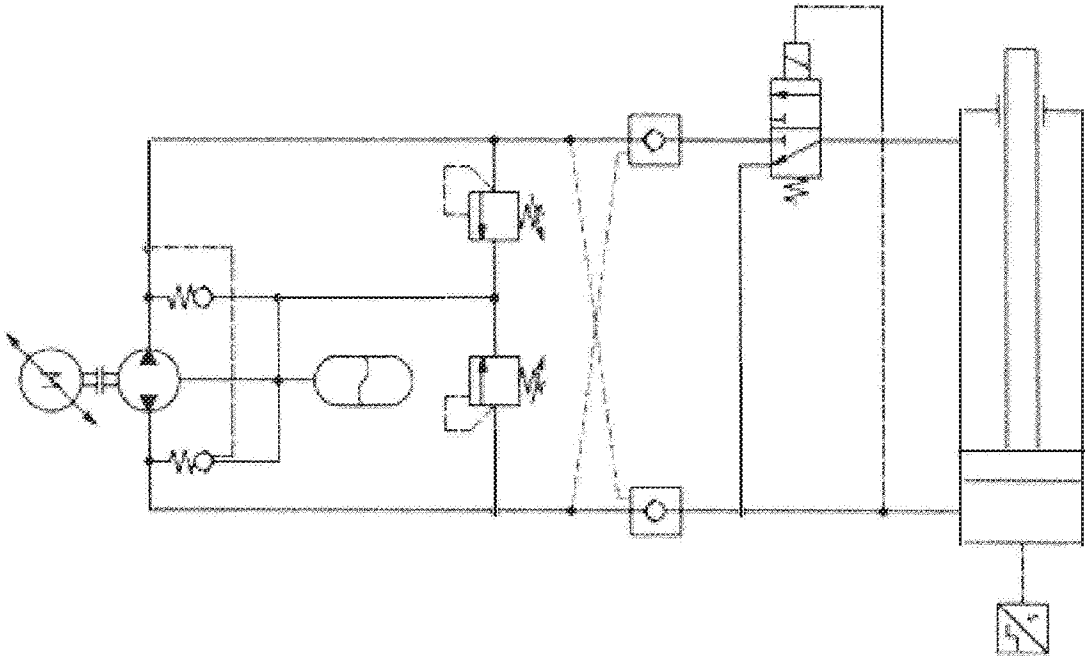
FIG. 3 shows an embodiment that is changed in regard to the actuation of the switching valve shown in FIG. 2.

FIG. 3 illustrates an embodiment similar to that in FIGS. 1 and 2. However, in this case electrical activation of switching valve 10 moves it into its blocking position.

Figure 4:
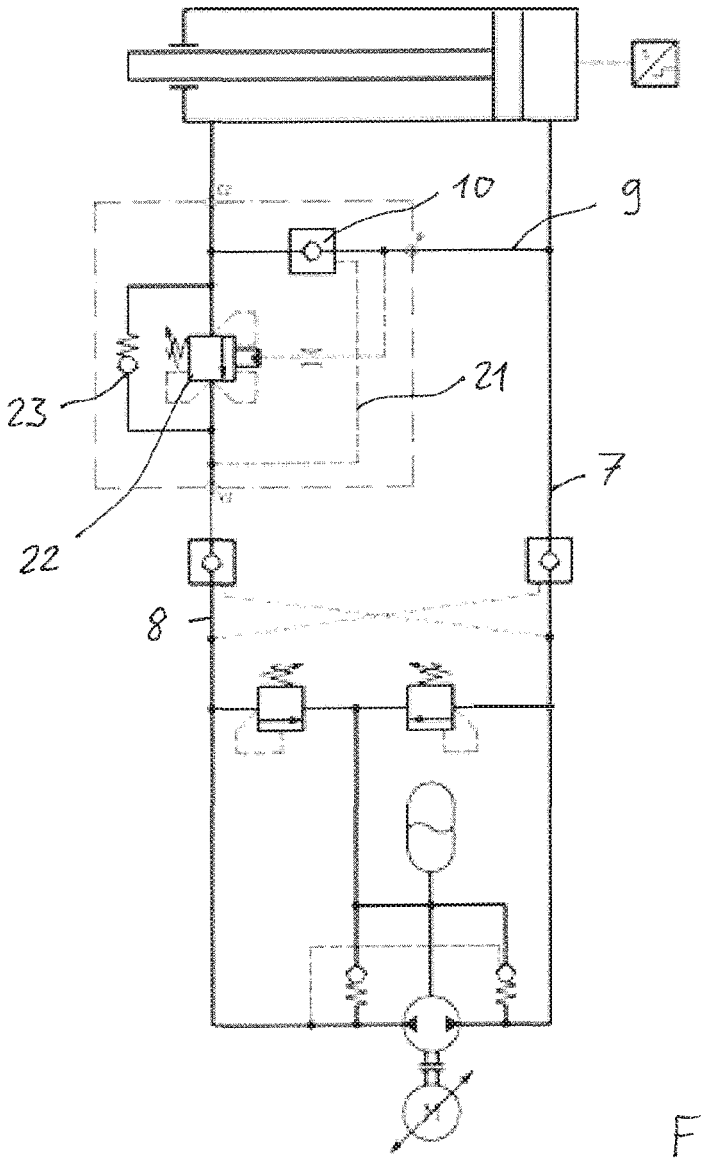
FIG. 4 shows another changed embodiment of the invention in regard to the activation of the switching valve.

In the embodiment shown in FIG. 4, switching valve 10 is positioned inside short-circuit line 9, in other words outside the two branches off hydraulic lines 7 and 8. Switching valve 10 can in particular be designed as a check valve, for example with forced actuation or respectively with forced opening. The forced opening is designed such that switching valve 10 is closed above a given pressure value in second hydraulic line 8, see control line 21.

A second hydraulic line 8, a pressure relief valve 22 is moreover provided, parallel to an additional check valve 23 which opens in the direction of cylinder chamber 2.

Check valves 15, 16 illustrated in FIGS. 2 to 4 operate as load holding valves in order to ensure a reliable stop of cylinder piston 3. However, the invention also manages without these valves.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hydraulic drive, comprising:

a differential cylinder having:

a cylinder chamber;

a cylinder piston being arranged in a displaceable manner in the cylinder chamber, the cylinder piston separating the cylinder chamber into a piston side and a ring side, each of the piston side and the ring side having a variable volume;

a piston rod being connected to the cylinder piston, the cylinder piston being arranged to extend and retract the piston rod, the piston rod being arranged on the ring side of the cylinder piston; and a short-circuit line having a single switching valve for optionally shutting off the short-circuit line in a fluid-tight manner, the short-circuit line connecting the piston side and the ring side in a fluid conducting manner, the switching valve being in the form of a multi-way valve including a spring to pre-load the multi-way valve into an open position, the spring being adapted to allow the multi-way valve to move into a blocking position when subjected to a pressure on the piston side; and a hydraulic pump being connected to the differential cylinder via a plurality of hydraulic lines, the plurality of hydraulic lines being configured to deliver a hydraulic fluid optionally to the piston side or the ring side and thus to displace the cylinder piston in alternating fashion in the cylinder chamber.

2. The hydraulic drive according to claim 1, wherein the multi-way valve is a 3/2 valve.

3. The hydraulic drive according to claim 1, wherein the hydraulic pump has two sides, each side being connected to the respective cylinder chamber via the respective hydraulic line, each hydraulic line having a check valve opening in the direction of the cylinder chamber.

4. The hydraulic drive according to claim 3, wherein each of the check valves include a control connection, the control connection configured to supply a variable force, the check valve being open when variable force is greater than a differential force that acts through an inlet and an outlet of the respective check valve.

5. The hydraulic drive according to claim 4, wherein the control connection of each check valve is interconnected crosswise such that opening of one check valve forcibly opens the other check valve.

6. The hydraulic drive according to claim 1, wherein each side of the hydraulic pump includes a hydraulic fluid reservoir connected to the respective side of the hydraulic pump via a fluid volume equalizer check valve.

7. The hydraulic drive according to claim 6, wherein each hydraulic fluid reservoir includes a pressure relief valve, each pressure relief valve in connection with a respective hydraulic line of the plurality of hydraulic lines.

8. The hydraulic drive according to claim 1, wherein the switching valve is switchable into the blocking position when the pressure is supplied to the ring side and to the piston side.

9. The hydraulic drive according to claim 8, wherein the switching valve is switchable hydraulically into the blocking position.

10. The hydraulic drive according to claim 1, wherein the hydraulic pump is reversible in its delivery direction.

* * * * *